US007805902B2

(12) United States Patent
Martel

(10) Patent No.: US 7,805,902 B2
(45) **Date of Patent: *Oct. 5, 2010**

(54) FASTENER FOR GROOVED OR SLOTTED DECKING MEMBERS

(75) Inventor: David Martel, Harwinton, CT (US)

(73) Assignee: Tiger Claw, Inc., Bristol, CT (US)

( * ) Notice: Subject to any disclaimer, the term of this patent is extended or adjusted under 35 U.S.C. 154(b) by 289 days.

This patent is subject to a terminal disclaimer.

(21) Appl. No.: 11/717,395

(22) Filed: Mar. 13, 2007

(65) Prior Publication Data

US 2007/0234670 A1 Oct. 11, 2007

Related U.S. Application Data

(60) Provisional application No. 60/785,230, filed on Mar. 23, 2006.

(51) Int. Cl.
*E04B 5/00* (2006.01)

(52) U.S. Cl. ..... 52/489.1; 52/512; 52/586.2; 52/582.1; 411/461; 411/470

(58) Field of Classification Search ..... 52/489.1, 52/489.2, 480, 512, 586.1, 586.2, 483.1, 52/582.1, 650.3; 411/457, 458, 460, 470, 411/461, 466

See application file for complete search history.

(56) References Cited

U.S. PATENT DOCUMENTS

| | | | | |
|---|---|---|---|---|
| 0,876,399 | A | 6/1908 | Robinson | |
| 1,714,738 | A * | 5/1929 | Smith | 52/512 |
| 1,879,459 | A | 9/1932 | Pelton | |
| 1,888,611 | A * | 11/1932 | Wolfson | 52/512 |
| 2,065,525 | A | 12/1936 | Hamilton | 411/460 |
| 2,066,813 | A | 1/1937 | Williams | |
| 2,116,737 | A * | 5/1938 | Urbain | 52/489.2 |
| 2,129,975 | A | 9/1938 | Urbain | 52/489.2 |
| 2,129,976 | A * | 9/1938 | Urbain et al. | 52/489.1 |
| 2,200,649 | A | 5/1940 | Wardle | |
| 2,214,939 | A | 9/1940 | Stirn | 403/276 |
| 2,270,284 | A | 1/1942 | Faggard | 411/473 |

(Continued)

OTHER PUBLICATIONS

Canadian Office Action dated Aug. 21, 2007 for Canadian Patent Application No. 2,506,970.

(Continued)

*Primary Examiner*—Brian E Glessner
(74) *Attorney, Agent, or Firm*—McCormick, Paulding & Huber LLP

(57) ABSTRACT

A hidden-type fastener for attaching laterally adjacent grooved decking members to an underlying support includes a body with a fastener opening, first and second connection wings, and a flange. The wings extend out from a top edge of the body in opposite directions. Each includes a first portion perpendicular to the body and a second portion oriented at an angle thereto. The flange is perpendicular to the body, and is attached to a bottom edge thereof. In use, the wing opposite the flange is placed in the groove of a first decking member. A connector is secured into the support through the opening, causing the fastener and wing to flex into engagement with the decking member. A second decking member is placed laterally against the first by maneuvering its side groove over the other wing, causing the wing to flex for engagement therewith.

35 Claims, 7 Drawing Sheets

U.S. PATENT DOCUMENTS

| | | | | | |
|---|---|---|---|---|---|
| 2,325,766 | A | | 8/1943 | Gisondi | |
| 2,338,870 | A | | 1/1944 | Praeger | |
| 2,362,252 | A | | 11/1944 | Ellinwood | |
| 2,620,705 | A | | 12/1952 | Podvinecz | 411/460 |
| 2,779,979 | A | | 2/1957 | Sundelin et al. | |
| 2,848,758 | A | | 8/1958 | Chisholm | |
| 3,020,602 | A | | 2/1962 | Siering | 52/714 |
| 3,267,630 | A | | 8/1966 | Omholt | |
| 3,284,117 | A | | 11/1966 | Meehan | |
| 3,331,180 | A | | 7/1967 | Vissing | |
| 3,439,464 | A | | 4/1969 | Omholt | |
| 3,500,604 | A | | 3/1970 | Vandall | |
| 3,553,919 | A | | 1/1971 | Omholt | 52/506.1 |
| 3,577,694 | A | | 5/1971 | Omholt | |
| 3,619,963 | A | | 11/1971 | Omholt | 52/481.1 |
| 3,731,445 | A | | 5/1973 | Hoffman et al. | |
| 4,052,831 | A | | 10/1977 | Roberts | 52/309.8 |
| 4,117,644 | A | | 10/1978 | Weinar | |
| 4,154,172 | A | * | 5/1979 | Curtis, Jr. | 105/422 |
| 4,281,494 | A | | 8/1981 | Weinar | |
| 4,296,580 | A | | 10/1981 | Weinar | |
| 4,333,286 | A | | 6/1982 | Weinar | |
| 4,408,427 | A | * | 10/1983 | Zilch | 52/481.2 |
| 4,435,935 | A | | 3/1984 | Larrea | |
| 4,448,007 | A | | 5/1984 | Adams | |
| 4,467,579 | A | | 8/1984 | Weinar | |
| 4,498,272 | A | | 2/1985 | Adams | |
| 4,598,518 | A | | 7/1986 | Hohmann | |
| 4,616,462 | A | | 10/1986 | Abendroth | |
| 4,620,403 | A | | 11/1986 | Field | 52/480 |
| 4,621,473 | A | | 11/1986 | Wendt | 52/489.2 |
| 4,703,601 | A | * | 11/1987 | Abendroth | 52/509 |
| 4,831,808 | A | | 5/1989 | Wynar | 52/715 |
| 4,925,141 | A | | 5/1990 | Classen | 248/217.2 |
| D312,772 | S | | 12/1990 | Paul | |
| 5,027,573 | A | | 7/1991 | Commins | 52/489.2 |
| 5,222,341 | A | * | 6/1993 | Watkins et al. | 52/547 |
| 5,390,457 | A | | 2/1995 | Sjolander | 52/387 |
| 5,394,667 | A | | 3/1995 | Nystrom | |
| 5,408,796 | A | | 4/1995 | Hashimoto et al. | |
| 5,642,597 | A | | 7/1997 | Hendrickson | 52/715 |
| 5,694,730 | A | | 12/1997 | Del Rincon et al. | |
| 5,738,473 | A | | 4/1998 | Tebo | 411/460 |
| 5,842,319 | A | | 12/1998 | Ravetto | 52/ 715 |
| 5,927,923 | A | | 7/1999 | Tebo | 411/458 |
| 5,997,209 | A | | 12/1999 | Sachs | 403/388 |
| 6,071,054 | A | | 6/2000 | Tebo | 411/459 |
| 6,094,882 | A | | 8/2000 | Pervan | |
| 6,134,854 | A | | 10/2000 | Stanchfield | |
| 6,237,295 | B1 | * | 5/2001 | Ballard | 52/589.1 |
| 6,266,937 | B1 | | 7/2001 | Watanabe | |
| 6,279,286 | B1 | | 8/2001 | Ichihashi | 52/489.1 |
| 6,299,400 | B1 | | 10/2001 | Tebo | 411/459 |
| 6,374,552 | B1 | * | 4/2002 | Price | 52/169.12 |
| 6,402,415 | B1 | | 6/2002 | Eberle, III | |
| 6,416,269 | B1 | | 7/2002 | Martel | 411/461 |
| 6,449,918 | B1 | * | 9/2002 | Nelson | 52/582.1 |
| 6,460,306 | B1 | * | 10/2002 | Nelson | 52/582.1 |
| 6,484,467 | B2 | * | 11/2002 | Crout | 52/483.1 |
| 6,490,838 | B2 | * | 12/2002 | Summerford | 52/650.3 |
| 6,497,395 | B1 | | 12/2002 | Croker | 248/300 |
| 6,540,432 | B2 | | 4/2003 | Albanese | |
| 6,594,961 | B2 | | 7/2003 | Leines | |
| 6,631,589 | B1 | | 10/2003 | Friedman et al. | |
| 6,691,471 | B2 | * | 2/2004 | Price | 52/169.12 |
| 6,711,864 | B2 | * | 3/2004 | Erwin | 52/582.1 |
| 6,763,643 | B1 | | 7/2004 | Mårtensson | |
| 6,766,992 | B1 | | 7/2004 | Parker | 248/300 |
| 6,810,633 | B2 | | 11/2004 | Harris, Sr. | |
| 6,871,467 | B2 | * | 3/2005 | Hafner | 52/586.1 |
| 6,880,305 | B2 | | 4/2005 | Pervan et al. | |
| 6,966,161 | B2 | | 11/2005 | Pálsson et al. | |
| 7,028,437 | B2 | | 4/2006 | Hauck | |
| 7,073,301 | B1 | * | 7/2006 | Price | 52/477 |
| 7,073,303 | B2 | * | 7/2006 | Baker | 52/586.1 |
| 7,207,147 | B2 | * | 4/2007 | Price et al. | 52/586.1 |
| 7,251,918 | B2 | * | 8/2007 | Reif et al. | 52/714 |
| 7,313,893 | B2 | * | 1/2008 | Voegele, Jr. | 52/461 |
| 7,398,623 | B2 | * | 7/2008 | Martel et al. | 52/489.2 |
| 7,409,803 | B2 | * | 8/2008 | Grohman | 52/489.1 |
| 7,503,146 | B2 | | 3/2009 | Thomas | |
| 2001/0015042 | A1 | | 8/2001 | Ballard | |
| 2002/0051680 | A1 | | 5/2002 | Albanese | |
| 2002/0056237 | A1 | | 5/2002 | Price | |
| 2002/0095897 | A1 | * | 7/2002 | Summerford | 52/489.1 |
| 2002/0121064 | A1 | * | 9/2002 | Erwin | 52/586.1 |
| 2003/0019174 | A1 | | 1/2003 | Bolduc | |
| 2003/0101673 | A1 | * | 6/2003 | West et al. | 52/489.1 |
| 2003/0121226 | A1 | | 7/2003 | Bolduc | 52/391 |
| 2004/0020152 | A1 | * | 2/2004 | Harris, Sr. | 52/582.1 |
| 2004/0182034 | A1 | * | 9/2004 | Eberle, III | 52/586.1 |
| 2004/0237460 | A1 | | 12/2004 | Green | |
| 2005/0252154 | A1 | | 11/2005 | Martel et al. | |
| 2006/0059822 | A1 | * | 3/2006 | Guffey | 52/480 |
| 2006/0156666 | A1 | | 7/2006 | Caufield | |
| 2006/0283122 | A1 | * | 12/2006 | Burgess et al. | 52/480 |
| 2006/0283126 | A1 | * | 12/2006 | Juan Puerta | 52/582.1 |
| 2008/0279654 | A1 | * | 11/2008 | Deschamps | 411/457 |

OTHER PUBLICATIONS

Tiger Claw Hidden Deck Fasteners [online]. Tiger Claw Inc. Retrieved from the Internet Archive Wayback Machine <URL: http://web.archive.org/web/20030810145836/http:www.deckfastener.com/products.htm.

Tiger Claw Inc., TC-X Fasteners, May 11, 2003, http://web.archive.org/web/20030621061553/www.deckfastener.com/products.htm.

Tiger Claw Inc., TC-3 Fastener, May 11, 2003, http://web.archive.org/web/20030621101925/www.deckfastener.com/TC-3.htm.

* cited by examiner

FASTENER FOR GROOVED OR SLOTTED DECKING MEMBERS

This application claims the benefit of U.S. Provisional Application Ser. No. 60/785,230, filed Mar. 23, 2006, hereby incorporated by reference herein in its entirety.

FIELD OF THE INVENTION

The present invention relates to a deck fastener for securing decking members (e.g., boards or planks) together and to a supporting member and, more particularly, to a fastener for securing grooved or slotted decking members to an underlying support member.

BACKGROUND OF THE INVENTION

Composite deck boards or planks have become increasingly common as a replacement or alternative to traditional wood planks for outside decking or the like. Composite boards are made of a combination of materials usually including a polymer matrix material and one or more reinforcement materials such as wood fibers, with the polymer matrix surrounding and supporting the wood fiber reinforcement material. The reinforcement material provides strength, workability, and dimensional stability, while the polymer matrix material provides low-maintenance characteristics, durability (especially in terms of color longevity), and splinter-free wear.

Composite deck boards may be fastened to underlying support members in the same manner as traditional wood planking, e.g., by driving a fastener down through the body of the deck board. Despite improved mechanical qualities, however, composite boards are still subject to possible splitting. Moreover, users prefer not to have fasteners protruding above the decking surface, as may be unsightly and/or create a hazard. For example, conventional nails, even if countersunk in the first instance, have a tendency to work themselves above the decking surface over time as the planking contracts and expands due to changing weather conditions. Accordingly, various systems have been proposed for securing deck boards together and to underlying supports in a "hidden" manner, e.g., the fasteners do not protrude above the decking surface.

The decking itself may be provided with features for facilitating "hidden" attachment. For example, FIGS. 1A and 1B show a generally rectangular, generally planar, composite plank 10 having an elongate body 12, first and second lateral ends 14, 16 (e.g., the ends are perpendicular to a longitudinal axis 18 of the plank, which is the axis defined by the longest dimension of the plank), and left and right longitudinal sides 20, 22 (e.g., the sides are parallel to the longitudinal axis 18 of the plank). Each side 20, 22 has a longitudinal groove or slot 24, 26 formed therein. In operation, a biscuit device such as shown in U.S. Pat. No. 6,402,415 to Eberle, III is used to hold adjacent planks together and to an underlying support. However, since the top of the biscuit-like device is only press fit into the grooves 24, 26, the connection between planks may not be as secure as desired. For example, the planks may be subject to shifting or other movement.

SUMMARY OF THE INVENTION

An embodiment of the present invention relates to a fastener for securing laterally adjacent, grooved decking members to an underlying support. ("Grooved decking member" refers to an elongate board, plank, or other construction member having generally planar top and bottom surfaces, such as those suitable for use as the surface of a deck, where one or both of the side edges of the member are provided with longitudinal grooves or slots.) The fastener includes a generally flat body portion with front and rear faces and top and bottom edges. A first connection wing is attached to the top edge of the body and extends outwardly from the rear face of the body in a first direction. A second connection wing is also attached to the top edge of the body, but extends generally outwardly from the front face of the body in a second, opposite direction. A flange is attached to the bottom edge of the body portion and extends outwardly from the rear face of the body in the general direction of the first connection wing. The flange and/or body portion include an opening for passage of a connector (e.g., screw) through the fastener. The connection wings are adapted in size and shape to engage laterally adjacent decking members when the wings are inserted into the longitudinal grooves formed in the sides of the decking members and the fastener is connected to a supporting member that supports and underlies the laterally adjacent decking members.

Thus, in use, a first decking member is held in place against the underlying support member. The fastener's second connection wing (e.g., the connection wing opposite the flange) is positioned in the decking member's longitudinal groove such that the connector opening is positioned proximate to the support member and the flange is facing away from the decking member. A screw or other connector is inserted through the opening and is secured in place down into the support member. (Typically, several fasteners are deployed in this manner at even intervals along the length of the decking member.) Then, a second decking member is placed laterally against the first decking member by maneuvering its longitudinal side groove over the fastener's first connection wing. The second decking member lies against the support member, and is then moved towards the first decking member until it abuts the flange, which establishes a gap between the two decking members. The connection wings engage the decking members in the slots for securing the decking members against the support member, e.g., lip-like portions of the decking members, which lie below the grooves, are sandwiched between the connection wings and the underlying support, preventing the decking members from being substantially raised upwards.

In another embodiment, the flange is generally perpendicular to the rear face of the body portion. In compensation for the gap created by the flange, the first connection wing (e.g., the wing positioned on the same side as the flange) is longer than the second connection wing in a latter manner. This means that the first connection wing extends out from the body portion by a lateral distance greater than that of the second connection wing. ("Lateral distance" refers to the distance between the body portion and the farthest, distal edge of the wing, as measured normally/perpendicularly to the front or rear face of the body portion, as applicable.)

In another embodiment, the connection wings are "bent" in shape, with each including first and second portions that are non-coplanar to one another. Thus, for example, for each connection wing, the first non-coplanar portion is attached to the top edge of the body and lies generally perpendicular to the fastener body portion. The second non-coplanar portion, which defines the distal end of the connection wing, is attached to an edge of the first portion opposite (and typically parallel to) the top edge of the body. The second portion is inclined at an angle with respect to the first portion for leveraged engagement of the connection wing with a decking member when inserted into a longitudinal groove thereof.

In use, a first grooved decking member is held in place against an underlying joist or other support member. The second, laterally shorter connection wing (e.g., the connection wing on the opposite side of the body from the flange) is angled into the decking member's longitudinal groove. In this position, the body of the fastener abuts the lower lip of the groove (or thereabouts), with the body and second wing lying in an inclined or angled position above the support member. Again, the fastener's connector opening is positioned proximate to the support member, and the flange faces away from the decking member. A connector is inserted through the connector opening and is secured in place down into the support member. As the fastener is secured in place, this causes the short connection wing and/or body to flex slightly, causing the angled, distal portion of the wing to firmly press up against or otherwise engage the decking member in the inside top of the groove. This prevents the decking member from being easily moved laterally away from the fastener. Subsequently, a second decking member is maneuvered in at a slight angle to position its longitudinal side groove over the first, laterally longer connection wing of the fastener. Allowing the second decking member to fall into place flat against the support member causes the long wing to flex slightly under the weight of the second decking member. This in turn causes the angled, distal portion of the long wing to frictionally engage the second decking member inside the groove, including possibly slightly biting into the decking member. This secures the second decking member in place in a positive leveraged manner.

In another embodiment, with respect to a geometrical plane defined by the perpendicular portions of the connection wings, the fastener body and flange are located on one side of the plane, and the angled or bent portions of the wings extend out past the opposite side of the plane. Typically, the angled or bent portions are angled from about 15° to about 75° with respect to the plane defined by the first connection wing portions.

In another embodiment, the connection wings are generally rectangular and have generally rectangular distal ends. The distal ends may be provided with wedge-shaped prongs, e.g., positioned at the left and right corners of the distal end, for the connection wings to bite into the decking members inside the longitudinal grooves.

BRIEF DESCRIPTION OF THE DRAWINGS

The present invention will be better understood from reading the following description of non-limiting embodiments, with reference to the attached drawings, wherein below.

DETAILED DESCRIPTION

Figure 1A:
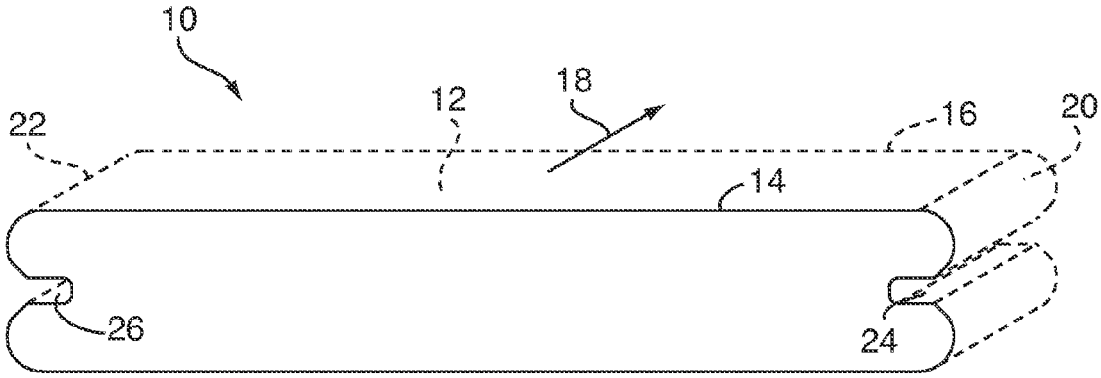
FIGS. 1A and 1B are views of a grooved decking member.
Figure 1B:
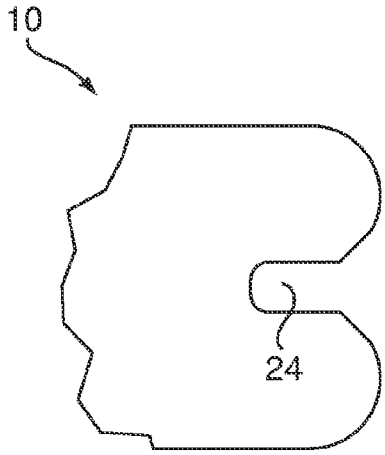
Figure 2A:
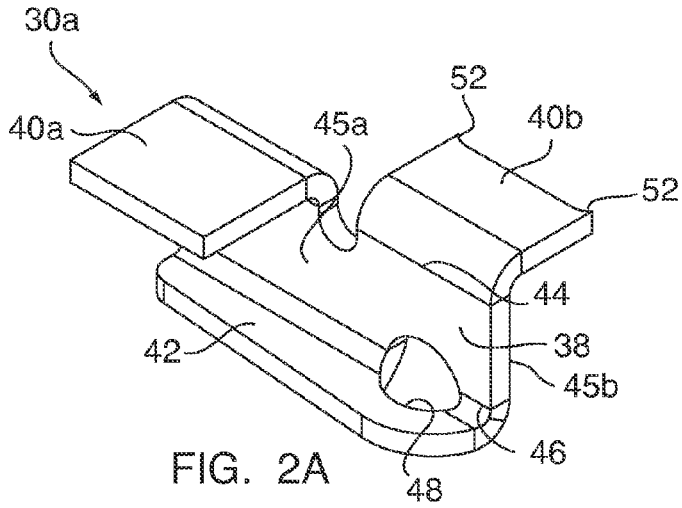
FIGS. 2A-2D are perspective, front side elevation, left side elevation, and bottom plan views, respectively, of a fastener for grooved or slotted decking members, according to a first embodiment of the present invention.
Figure 2B:
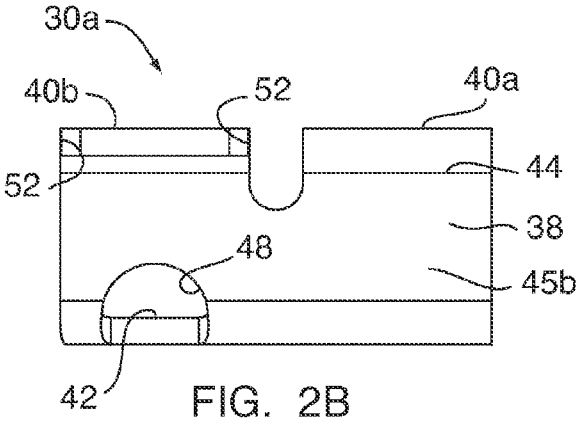

Referring to FIGS. 2A-5D, the present invention relates to a novel fastener device 30*a*, 30*b* for connecting (i) a first grooved or slotted board, plank, or other decking member 32 to an underlying joist or other support member 34 and (ii) a second grooved decking member 36 to the first decking member 32 in an adjacent or lateral manner. (In other words, the fastener 30*a*, 30*b* is used, in effect, to connect two decking members to one another and both decking members to an underlying support 34.) The fastener 30*a*, 30*b* includes a thin, flat body portion 38, two connection lips or "wings" 40*a*, 40*b*, and a main flange 42. The wings 40*a*, 40*b* extend out from the top edge 44 of the body portion 38 in opposite directions. In particular, the first wing 40*a* is attached along one side of the top edge 44 of the body 38, and extends outwardly from the body in the direction of a rear face 45*a* of the body portion. The second wing 40*b* is attached along the other side of the top edge 44 of the body 38, and extends outwardly from the body in the direction of a front face 45*b* of the body portion. ("Front" and "rear" are arbitrary designations.) The connection wings 40*a*, 40*b* may be oriented generally perpendicularly to the body portion 38. The flange 42 extends outwardly from the bottom edge 46 of the body portion in the direction of the rear face 45*a* of the body 38, and lies generally perpendicular thereto. The body 38 and/or flange 42 include an opening 48 for passage of a connector, such as a screw 50. The connection wings 40*a*, 40*b* may be generally flat, as is the case with the fastener 30*a* shown in FIGS. 2A-2D and 4A-4C. The leading edge of one or both wings may be provided with prongs 52. Alternatively, as is the case with the fastener 30*b* shown in FIGS. 3A, 3B, and 5A-5D, each connection wing may include first and second non-coplanar portions 54, 56. The first, "flat" portion 54 is connected to the body 38, and the second, "bent" portion 56 is inclined at an angle to the first portion 54. In this case, the first wing portion 54 is generally perpendicular to the body 38, while the second portion 56 extends upwardly and outwardly away from the body 38, e.g., oriented at an angle $\alpha$ to the body, wherein, typically, $\alpha$=45° or thereabouts. Both wings 40*a*, 40*b* are generally rectangular, although the bent portion may be provided with prongs or teeth 52 for better engaging grooved decking members or other construction members. As best shown in FIGS. 2A and 2C, the wing 40*a* that extends out in the same direction as the flange 42 may be slightly longer than the other wing 40*b*, in a lateral direction from the body. The former is occasionally referred to herein as the "long" wing 40*a*, the latter the "short" wing 40*b*.

As noted above, "decking member" refers to any type of elongate board, plank, or other construction member having generally planar top and bottom surfaces, such as those suitable for use as the primary surface of a deck, and regardless of how the members are manufactured or the material(s) from which they are made. This encompasses wood, composites, laminates, polymers, and the like. Also, when it is referred to herein that the decking member grooves or slots are "formed" in the decking members, this includes any manufacturing operation resulting in the provision of the grooves/slots, such as molding, machining, the connection of varying-width laminates, or the like.

Figure 4A:
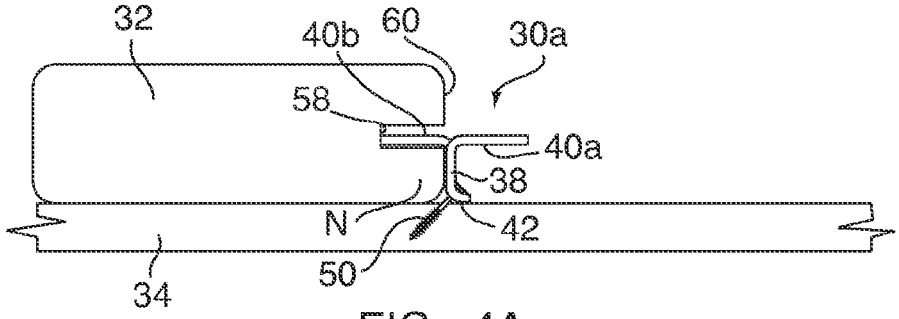
FIGS. 4A-4C and 5A-5D are side elevation views showing the fasteners in use.
Figure 4B:
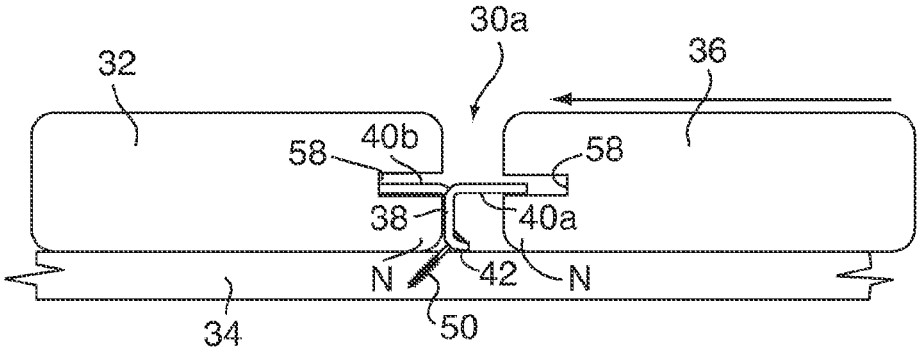
Figure 4C:
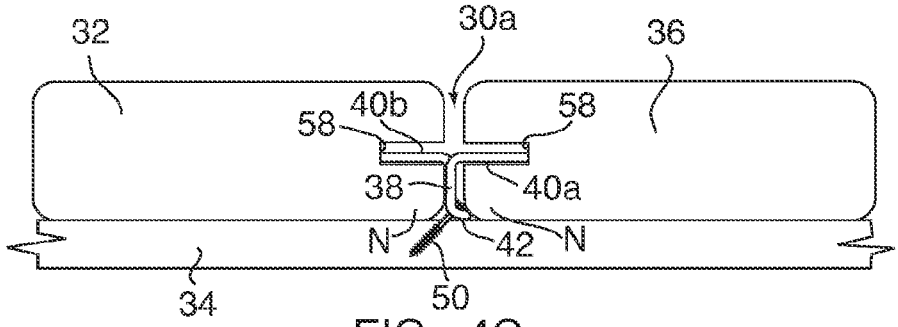

For using the fastener 30*a*, with reference to FIGS. 4A-4C, a first grooved decking member 32 is held in place against an underlying joist or other support member 34, e.g., the support member may be temporarily manually held against the joist, or it may be temporarily held using clamps or the like. The grooved decking member 32 has a longitudinal side groove or slot 58 formed in one or both of the member's long/lateral sides 60. (The decking member may be used as decking, whereby a number of the decking members are placed across the support members to form a deck.) The short wing 40*b* is positioned in the groove 58 such that the opening 48 is positioned proximate to the support member and the flange 42 faces away from the decking member 32. A screw or other connector 50 is inserted through the opening 48 and is secured in place down into the support member 34. Subsequently, as shown in FIG. 4B, a second decking member 36 is placed laterally against the first decking member by maneuvering its side groove 58 over the long wing 40*a*. The second decking member 36 is then moved towards the first decking member 32, as shown in FIG. 4C, until it abuts the flange 42, which establishes a gap between the two decking members. The connection wings 40*a*, 40*b* engage the decking members in the slots for securing the decking members against the support member, e.g., longitudinal lip portions "N" of the decking members, which lie below the grooves 58, are sandwiched between the connection wings 40*a*, 40*b* and the support 34, preventing the decking members from being raised upwards.

Typically, several of the fasteners 30*a* will be deployed at even intervals along the length of the decking member 32, for securing it to the support 34 along its length. After the second decking member 36 is positioned in place as shown in FIGS. 4B and 4C, the opposite side of the second decking member 36 is outfitted with additional fasteners. Thus, each decking member is held along both its side edges. End decking members may be held in place through abutment to structural members or the like, through the use of other fasteners, or through provision of "one sided" fasteners, such as the fastener 30*a* but without a connection wing 40*a*.

Figure 5A:
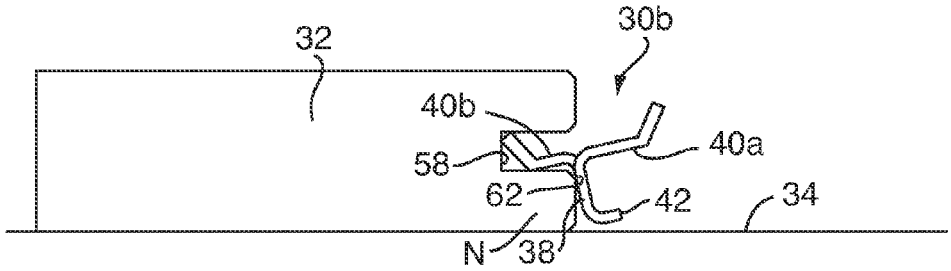
Figure 5B:
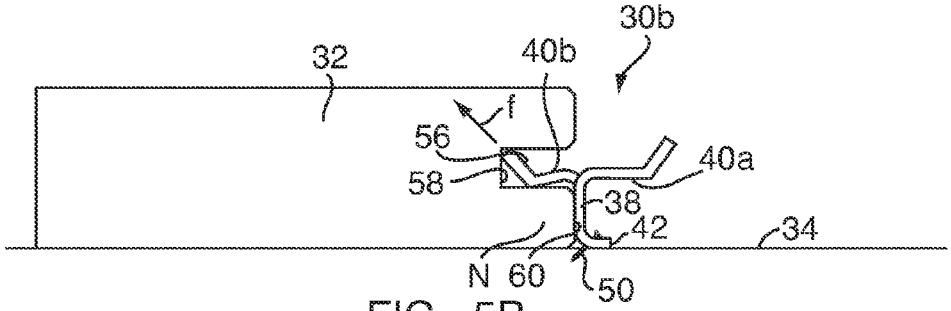
Figure 5C:
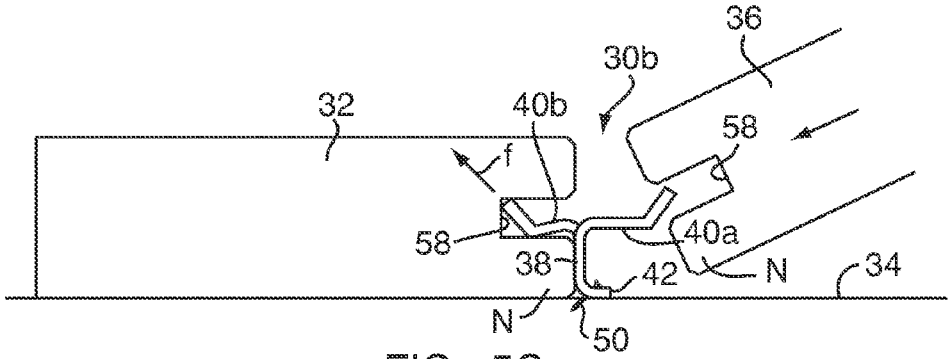
Figure 5D:
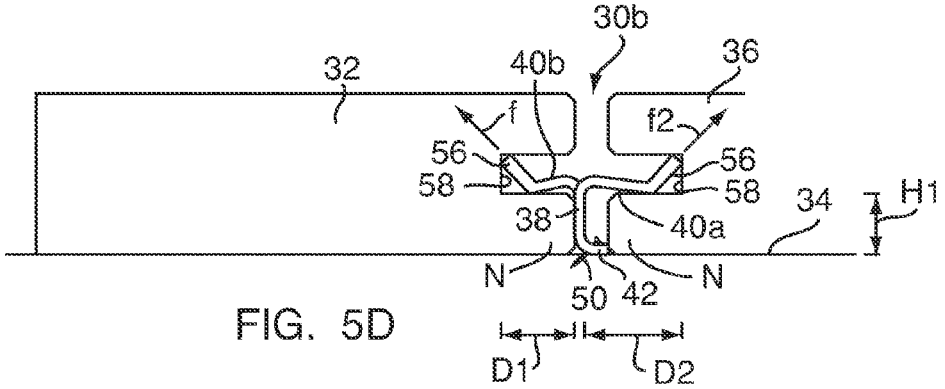

With reference to FIGS. 5A-5D (not to scale), the fastener 30*b* with bent wings 40*a*, 40*b* provides a positive leverage lock between the decking members and support member, resulting in an even more secure connection. In particular, a first grooved decking member 32 is held in place against an underlying joist or other support member 34. The short wing 40*b* of the fastener 30*b* is angled into the groove 58. In this position, the body 38 of the fastener abuts the lower edge 62 of the groove 58 (or thereabouts), with the body 38 and second wing 40*a* lying in an inclined or angled position above the support member 34. (See FIG. 5A.) Again, the opening 48 is positioned proximate to the support member, and the flange 42 faces away from the decking member 32. As shown in FIG. 5B, a connector 50 is inserted through the opening 48 and is secured in place down into the support member 34. As the connector is secured in place, this causes the short wing 40*b* and/or body 38 to flex slightly, causing the bent portion 56 of the short wing 40*b* to firmly press up against or otherwise engage the inside top of the groove 58, as indicated by the arrow "f." (In other words, as the fastener is screwed into place, the fastener body 38 is flexed against the side 60 of the decking member, which in effect levers the short wing 40*b* into frictional and/or "biting" engagement with the decking member.) This prevents the decking member 32 from being easily moved laterally away from the fastener 30*b*. Subsequently, a second decking member 36 is maneuvered in at a slight angle to place its side groove 58 over the long wing 40*a*, as shown in FIG. 5C. Allowing the second decking member 36 to fall flat against the support member 34 causes the long wing 40*a* to flex slightly under the weight of the second decking member 36. This causes the bent portion 56 of the long wing 40*a* to frictionally engage the second decking member inside the groove 58, as indicated by the arrow "f2", including possibly slightly biting into the decking member. This secures the second decking member in place. Additional decking members may be attached laterally in a similar manner. It should be noted that even if the second decking member's elevation is off, the long connection wing 40*a* will still tend to hold the decking member down in place against or proximate to the support 34.

Figure 6:
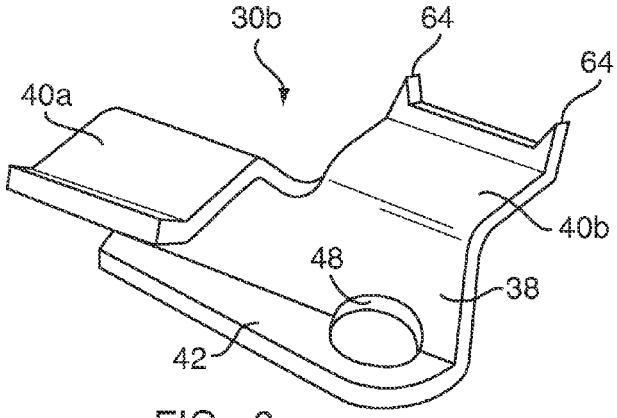
FIG. 6 is a perspective view of an alternative embodiment of the fastener shown in FIGS. 3A and 3B.

As shown in FIG. 6, the fastener 30*b* (or 30*a*) may be provided with elongated or pronounced prongs 64, on either or both of the wings 40*a*, 40*b*, for a more pronounced biting engagement with a decking member groove.

The dimensions and relative orientations of the various component portions of the fasteners 30*a*, 30*b* will vary depending on the characteristics and/or dimensions of the decking members with which they are used. Thus, the fasteners 30*a*, 30*b* can be considered as being complementary to the decking members 32, 36 in terms of the relative dimensions and positioning of the fastener components and decking member slots or grooves 58. For example, with reference to FIG. 5D, an overall height "H1" of the fastener body portion and flange will approximately correspond to the height of the decking member lip "N", at least insofar as the height H1 allows for the connection wings to extend into the slots 58 when the flange 42 abuts the underlying support 34. Also, the distances D1, D2 that the connection wings extend out laterally from the front and rear faces of the fastener body portion, respectively, are such that the connection wings extend into the slots at least a sufficient distance to engage the decking members in the slots, in consideration of the depths of the slots and the width of the gap established by the flange 42. ("Lateral" extension in this case refers to the distance between the distal end of the connection wing and the nearest of the front or rear faces of the fastener body portion, as measured normally/perpendicularly to a plane defined by the nearest face. "Distal" end or edge refers to the portion of the connection wing lying farthest away from the body portion, again, as measured normally.)

Figure 2C:
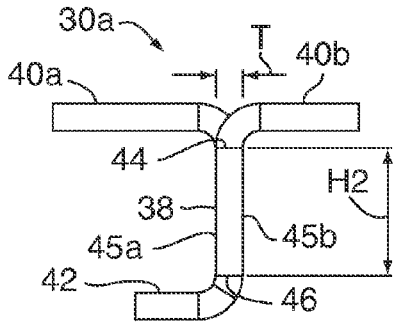
Figure 2D:
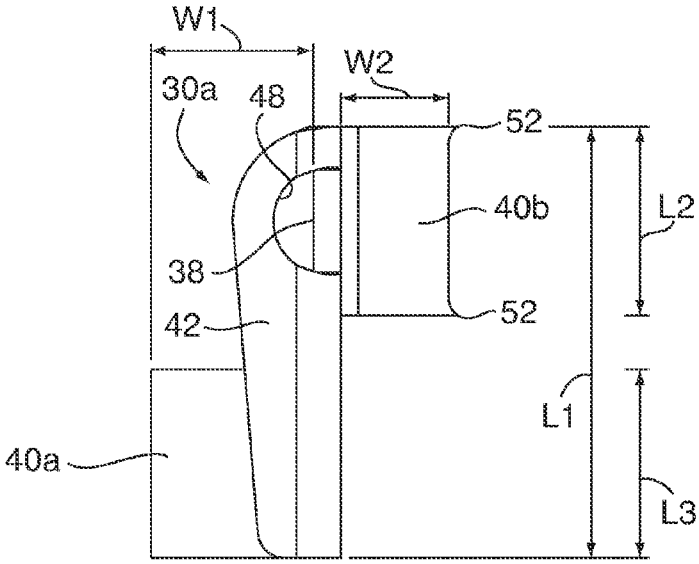

Although the dimensions of the fasteners will vary depending on the decking members, the following dimensions are for one embodiment of the fastener, provided as a typical example, and to confer a sense of scale. With reference to FIGS. 2C and 2D, a length L1 of the body portion 38 is about 1.0" (length is measured with respect to a longitudinal axis of the body, which is the axis lying parallel to the flange and connection wings). The lengths L3, L2 of the connection wings 40*a*, 40*b* are each about 0.4-0.5". The widths W1, W2 of the wings are also each about 0.4-0.5", with the width W1 being longer than the width W2 to compensate for the flange 42 (width is measured normal to the body portion). The height "H2" of the flat body portion 38 is about 0.3", where height is measured normally to the flange and connection wings. A thickness "T" of the fastener is about 0.05-0.06".

Figure 3A:
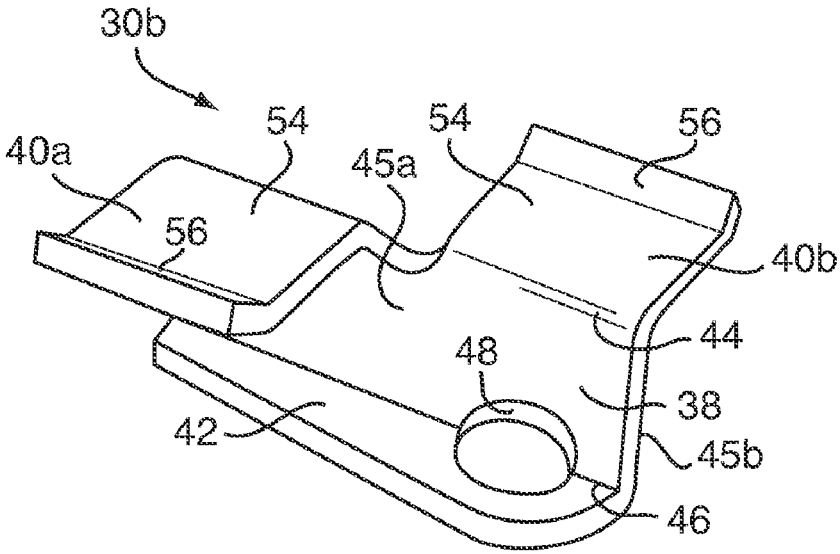
FIGS. 3A and 3B are perspective and side elevation views, respectively, of a fastener according to an additional embodiment of the present invention.
Figure 3B:
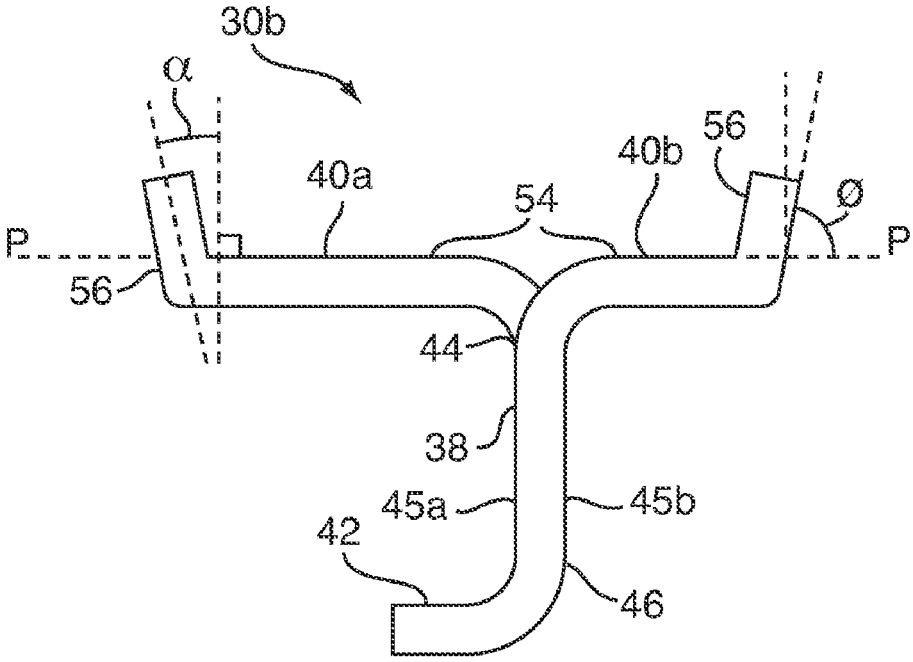

With reference to FIG. 3B, for fasteners with non-coplanar connection wings, e.g., fastener 30*b*, the angle $\alpha$ of the "bent" portions 54 (angle $\alpha$ is with respect to the body 38) may be varied depending on the dimensions of the decking member grooves 58 and on the degree to which it is desired to have the connection wings flex or bend during installation. Typical values of $\alpha$ range between about 15° and about 75°. (With respect to a plane "P" defined by the flat wing portions 54, the plane being perpendicular to the body 38, the bent portions 54 are angled up from the plane P by an angle $\phi=(90°-\alpha)$, e.g., $\phi$ is typically 45°, but may range from about 15° to about 75°.)

Figure 7A:
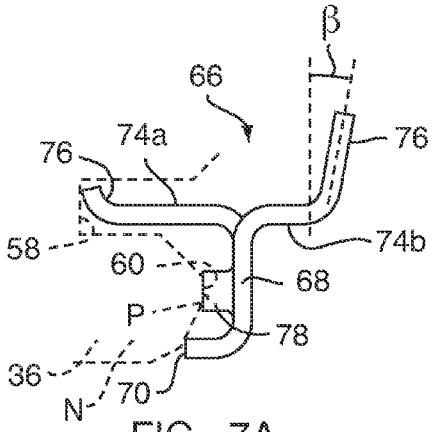
FIGS. 7A-7C are end side elevation, rear side elevation, and bottom plan views, respectively, of a fastener according to an additional embodiment of the present invention.
Figure 7B:
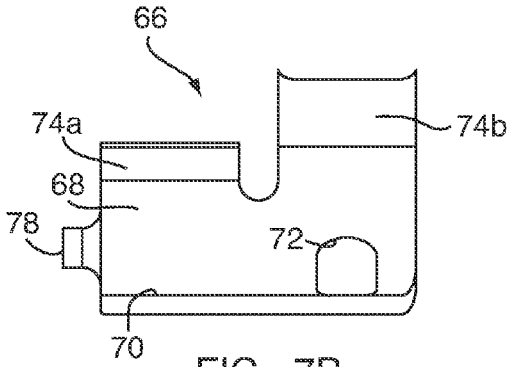
Figure 7C:
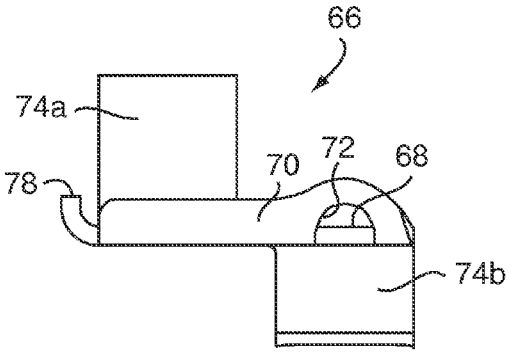

FIGS. 7A-7C show an additional embodiment of the present invention, which further illustrates possible variances in component dimensions. Here, a fastener 66 is generally similar to the fastener 30*b* shown in FIGS. 3A and 3B, and includes a body 68, flange 70, opening 72, and "long" and "short" connection wings 74*a*, 74*b*, respectively. However, the "bent" portion 76 of the short connection wing 74*b* is significantly longer than the bent portion 56 of the short connection wing 40*b* of the fastener 30*b*. With reference to FIG. 5A, and depending on the dimensions of the decking member groove 58, this may result in a greater inclination angle β of the fastener body when the short connection wing is inserted in the groove. An increased inclination angle may require a greater force to drive a fastener 50 and flex the connection wing, possibly resulting in a greater degree of flex and a tighter connection. The fastener 66 further includes an optional side flange 78. The side flange 78 is connected to the body 68 at the end of the body 68 opposite the opening 72. The side flange 78 is approximately perpendicular to the body 68, and extends in the same direction as the main flange 70. The side flange 78 helps to augment the spacing function of the main flange 70 by abutting the side 60 of the decking member 36, e.g., as at point P in FIG. 7A.

Figure 8A:
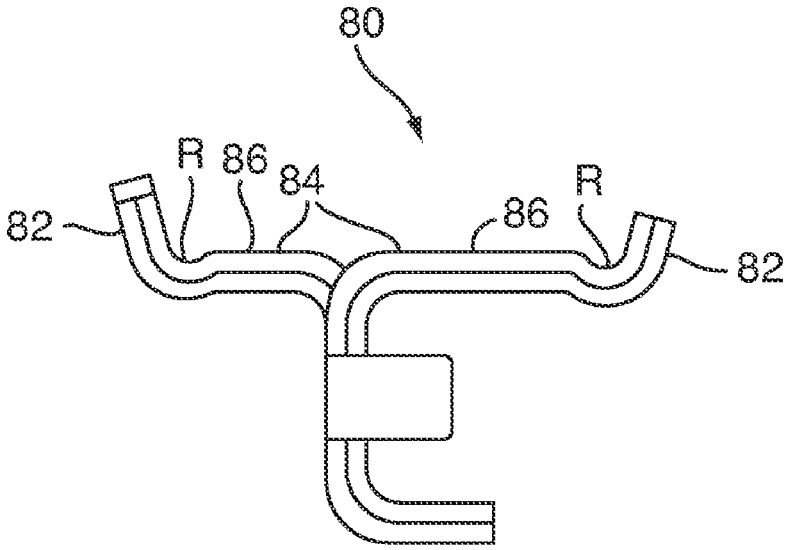
FIGS. 8A and 8B are end side elevation and top plan views, respectively, of a fastener according to an additional, embodiment of the present invention.
Figure 8B:
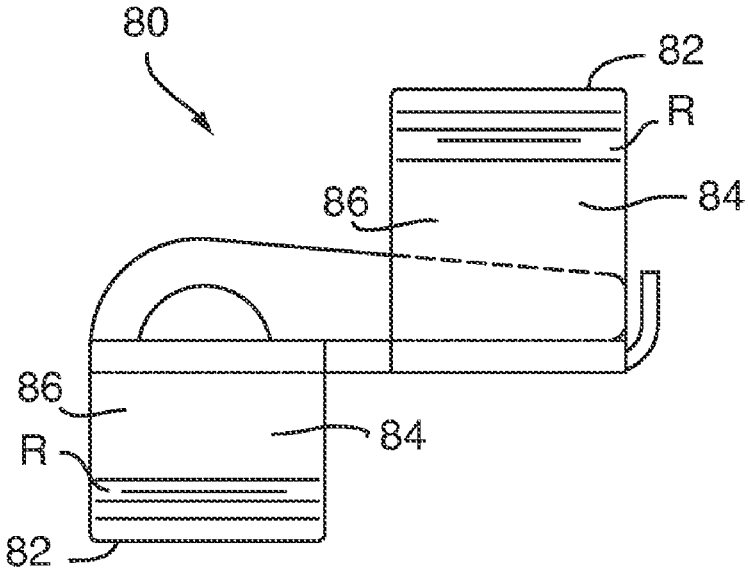

FIGS. 8A and 8B show an additional fastener embodiment 80. The fastener 80 is generally similar to the fasteners described above. Here, however, the "bent" portion 82 of each connection wing 84 is connected to the flat portion 86 by way of a radius "R." (In other words, the boundary between the bent portion and flat portion is provided with a curved groove or indentation having a radius R.)

Although the first, "flat" wing portions 54, 86, etc. have been illustrated as lying generally perpendicular to the body, the first wing portions could be disposed at a different angular orientation other than 90° without departing from the spirit and scope of the invention.

The fasteners (30*a*, 30*b*, 66, 80) may be characterized as having: a generally flat body portion (38, 68); flange means (42, 70) connected to the body portion for establishing a gap between laterally adjacent decking members (32, 36); and connection means, namely, the wings (40*a*, 40*b*, 74*a*, 74*b*, 84), connected to the body portion (38, 68) for engaging the laterally adjacent decking members (32, 36). As noted above, the connection wings engage the decking members within the laterally adjacent grooves formed in the sides of the decking members.

As used herein in a conventional manner, the term "about" refers to ±1 of the least significant digit of the value in question, e.g., "about 45°" means 45°±1°.

The fasteners (30*a*, 30*b*, 66, 80) may be made of metal or some other suitably strong and durable material, using standard manufacturing methods. Also, the fastener may be manufactured by cutting or stamping an appropriately dimensioned flat blank from a piece of sheet metal, and then bending the blank to form the fastener as shown. In such a case, the fastener will be a unitary member, wherein each connection wing will extend out from one side of the fastener body only, i.e., each will commence at the top edge of the body and extend outwards from the front or rear face, as applicable, without extending past or otherwise breaking a plane defined by the other face. The same is true for the flanges.

Because the fasteners are complementary in shape to the decking members, an embodiment of the present invention may be characterized as a decking system that includes first and second decking members (32, 36) and a complementary-shaped fastener (30*a*, 30*b*, 66, 80) for securing the decking members together and to a support member 34 that underlies and supports the decking members. The decking members are elongate, with each having generally planar, generally parallel top and bottom surfaces interconnected by left and right longitudinal side edges (20, 22). At least one of the side edges of each decking member has a longitudinal slot (24, 26, 58) formed therein. Subsequent to installation, a first longitudinal slot formed in the first decking member will lie laterally adjacent and opposed to a second slot formed in the second decking member. The fastener (30*a*, 30*b*, 66, 80) includes a generally flat body portion (38, 68) having rear and front faces (45*a*, 45*b*). The body portion is positioned between the laterally adjacent decking members. A first connection wing (40*a*, 74*a*, 84) is attached to the body and extends outwardly from the rear face 45*a* of the body and into the second longitudinal slot of the second decking member 36. A second connection wing (40*b*, 74*b*, 84) is attached to the body and extends outwardly from the front face 45*b* of the body and into the first longitudinal slot of the first decking member 32. A flange (42, 70) is attached to a bottom edge of the body portion and extends outwardly from the rear face 45*a* of the body. A bottom surface of the flange abuts the support member 34, and a distal edge of the flange abuts the second decking member 36. The fastener is connected to the support member by way of an elongate connector 50 extending through an opening 48 in the fastener and into the support member. The opening 48 extends through and is defined by the flange and/or body. The connection wings (40*a*, 40*b*, 74*a*, 74*b*, 84) engage the decking members in the slots for securing the decking members against the support member 34.

As should be appreciated, the fastener (30*a*, 30*b*, 66, 80) corresponds to the shape and dimensions of the decking members, such that when the decking members lie against the support member and the fastener is attached to the support member, the connection wings extend into the decking member longitudinal grooves for engaging the decking members inside the grooves. Thus, as explained above, the height of the fastener body portion and flange (measured from the bottom surface of the flange to the top edge of the flat body portion) will approximately correspond to the height of the decking member lip N, as measured normally from the flat bottom surface of the decking member. Also, the distances that the connection wings extend out laterally from the front and rear faces of the fastener body portion, respectively, are such that the connection wings extend into the decking member longitudinal grooves by at least a distance sufficient to engage the decking members in the grooves, in consideration of the depths of the grooves, the particular shape and dimensions of the connection wings, and the width of the gap established by the flange.

As noted above, the connection wings may be "bent" in shape, with each including first and second non-coplanar portions oriented at a non-zero degree angle with respect to one another. In such a case, during installation the connection wings are flexed downwards towards the flange. This causes the connection wings to exert a leveraged force at least partly upwards against the decking members in the slots for facilitating engagement of the connection wings with the decking members. More specifically, the second connection wing (opposite the flange) is flexed upon the connector being tightened into the support member through the connector opening. The tightening action draws the fastener body portion into butting engagement with the first decking member. (See FIGS. 5A and 5B.) The first connection wing (located on the same side of the fastener body as the flange) is flexed upon placement of the second decking member against the support member subsequent to angling the slot of the second decking member over the first connection wing.

Since certain changes may be made in the above-described fastener for grooved or slotted decking members, without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A fastener for securing laterally adjacent, grooved decking members having longitudinal grooves having an upper surface formed in a side of the decking members to an underlying support that supports and underlies the decking members, said fastener comprising:

a generally flat body portion having front and rear faces and top and bottom edges;

a first connection wing attached to the top edge of the body portion and extending generally outwardly from the rear face of the body portion in a first direction;

a second connection wing attached to the top edge of the body portion and extending generally outwardly from the front face of the body portion in a second direction, generally opposite the first direction; and a main flange attached to the bottom edge of the body portion and extending generally outwardly in the first direction from the rear face of the body portion;

wherein at least one of the main flange and the body portion defines an opening for passage of an elongated connector, the first and second connection wings are adapted in size and shape to engage decking members when the connection wings are positioned in longitudinal grooves of the decking members and the fastener is connected to a supporting member, each connection wing comprises first and second non-coplanar portions, each first non-coplanar portion abuts the body portion and each second non-coplanar portion abuts the respective first non-coplanar portion, defines a distal end of the respective connection wing, and is inclined at an angle with respect to the first non-coplanar portion for engaging an upper surface of a longitudinal groove, the first non-coplanar portions of both connection wings are generally flat and lie in a plane that is generally perpendicular to the body portion, the second non-coplanar portions of both connection wings are disposed at angles with respect to the plane defined by the first non-coplanar portions, the angle of one of the second non-coplanar portions with respect to the plane being different from the angle of the other second non-coplanar portion.

2. The fastener of claim 1, wherein:

the main flange is generally perpendicular to the rear face of the body portion for establishing a gap between laterally adjacent decking members greater than a thickness of the body portion; and the first connection wing extends out from the body portion by a lateral distance greater than that of the second connection wing, in compensation for the gap established by the main flange when the first connection wing is inserted into a longitudinal groove of a decking member.

3. The fastener of claim 2, wherein the connection wings extend outward from the top edge of the body portion and terminate at the respective distal ends, wherein each distal end is generally rectangular and defines a distal edge of the connection wing, said distal edge being generally parallel to the top edge of the body portion.

4. The fastener of claim 3, wherein the distal ends of the connection wings each include left and right corners, wherein the left and right corners of at least one of the distal ends of the connection wing each extend outward in a wedge shape past the distal edge, for enhancing engagement of the connection wing with a decking member.

5. The fastener of claim 1, wherein for each connection wing, the first non-coplanar portion is attached to the top edge of the body portion and lies generally perpendicular to the body portion, and the second non-coplanar portion is attached to an edge of the first non-coplanar portion opposite the top edge of the body portion, wherein the second non-coplanar portion is inclined at the angle with respect to the first non-coplanar portion for leveraged engagement of the connection wing with a decking member when inserted into a longitudinal groove of a decking member.

6. The fastener of claim 5, wherein each of the first and second non-coplanar portions is generally flat and generally rectangular.

7. The fastener of claim 1, wherein the first and second connection wings extend outward from the top edge of the body portion and terminate at the respective distal ends, wherein each distal end is generally rectangular and has a distal edge generally parallel to the top edge of the body portion.

8. The fastener of claim 7, wherein the distal ends of the first and second connection wings each include left and right corners, wherein each of the left and right corners of at least one of the distal ends of the first and second connection wings extends outward past the parallel distal edge of the distal end in a wedge shape, for enhancing engagement of the connection wing with a decking member.

9. The fastener of claim 5, wherein said body portion and said main flange lying on a first side of said plane, and the second non-coplanar portions extending outwardly from a second, opposite side of said plane at the angle with respect to the first non-coplanar portions.

10. The fastener of claim 9, wherein the second non-coplanar portions are angled at between about 15° and about 75° with respect to the plane defined by the first non-coplanar portions.

11. The fastener of claim 1, wherein:

the body portion has left and right parallel edges extending between the top and bottom edges of the body portion, said left and right edges defining the lateral bounds of the body portion, the main flange, and the first and second connection wings; and the first and second connection wings are coterminous with the left and right edges of the body portion, respectively.

12. The fastener of claim 11, further comprising a side flange attached to one of the left and right edges of the body portion, wherein a distal portion of the side flange is generally perpendicular to the body portion, and wherein the side flange extends out from the body portion in the first direction of the main flange.

13. A fastener for securing laterally adjacent, grooved decking members having a longitudinal groove having an upper surface formed in a side of the decking members to an underlying support that supports and underlies the decking members, said fastener comprising:

a generally flat body portion having front and rear faces;

a first connection wing attached to the body portion and extending outwardly from the rear face of the body portion in a first direction;

a second connection wing attached to the body portion and extending outwardly from the front face of the body portion in a second direction generally opposite the first direction; and a flange attached to a bottom edge of the body portion and extending outwardly from the rear face of the body portion in the first direction;

wherein at least one of the flange and the body portion defines an opening for passage of an elongated connector for connecting the fastener to an underlying support, each connection wing comprises first and second non-coplanar portions, each first non-coplanar portion abuts the body portion and each second non-coplanar portion abuts the respective first non-coplanar portion and defines a distal end of the respective connection wing, the first and second non-coplanar portions are for leveraged engagement of the connection wings with the decking members when the connection wings are inserted into a longitudinal groove of the decking members, each second non-coplanar portion is inclined at an angle with respect to the first non-coplanar portion for engaging an upper surface of the longitudinal groove, and the connection wings are asymmetrical with respect to each other for ensuring engagement in the longitudinal groove.

14. The fastener of claim 13, wherein for each connection wing, the first non-coplanar portion is attached to a top edge of the body portion and lies generally perpendicular to the body portion, and the second non-coplanar portion is attached to an edge of the first non-coplanar portion opposite the top edge of the body portion and defines a distal edge of the connection wing.

15. The fastener of claim 14, wherein the first non-coplanar portions of both connection wings are generally flat and together define a plane that is generally perpendicular to the body portion, said body portion and said flange lying on a first side of said plane only, and said second non-coplanar portions extending outwardly from a second, opposite side of said plane and being inclined at the angle with respect to the first non-coplanar portions.

16. A fastener for securing laterally adjacent, grooved decking members having longitudinal grooves having an upper surface formed in the decking members to an underlying support that supports and underlies the decking members, said fastener comprising:

a generally flat body portion having generally planar front and rear faces, top and bottom edges, and left and right side edges, said top and bottom edges defining vertical limits of the body portion and said left and right side edges defining horizontal limits of the body portion, said body portion extending between said edges;

a first connection wing comprising first and second generally flat non-coplanar portions, wherein the first non-coplanar portion is attached to the top edge of the body portion and extends generally perpendicularly outwardly from the rear face of the body portion, and the second non-coplanar portion is attached to an edge of the first non-coplanar portion parallel and opposite the top edge of the body portion, said second non-coplanar portion defining a distal end of the first connection wing that is spaced apart from the rear face of the body portion by a first lateral distance;

a second connection wing comprising first and second generally flat non-coplanar portions, said first and second non-coplanar portions being non-coplanar to one another, wherein the first non-coplanar portion is attached to the top edge of the body portion and extends generally perpendicularly outwardly from the front face of the body portion in a direction opposite that of the first non-coplanar portion of the first connection wing, and wherein the second non-coplanar portion is attached to an edge of the first non-coplanar portion parallel and opposite the top edge of the body portion, said second non-coplanar portion defining a distal end of the second connection wing that is spaced apart from the front face of the body portion by a second lateral distance;

a flange attached to the bottom edge of the body portion and extending outwardly from the rear face of the body portion, wherein at least a portion of the flange is generally perpendicular to the body portion, and wherein a distal edge of the flange is spaced apart from the rear face of the body portion by a third lateral distance for establishing a gap between laterally adjacent decking members greater than a thickness of the body portion; wherein:

at least one of the flange and the body portion defines an opening for passage of an elongated connector for connecting the fastener to an underlying support;

the first non-coplanar portions of the connection wings together define a plane that is generally perpendicular to the body portion, said body portion and the flange lying on a first side of said plane, and said second non-coplanar portions extending outwardly from a second, opposite side of said plane at a non-zero degree angle with respect to the plane;

the first lateral spacing distance of the first connection wing is greater than the second lateral spacing distance of the second connection wing and the third lateral spacing distance of the flange, in compensation for the flange-established gap when the first connection wing is inserted into a longitudinal groove of a decking member;

the second lateral spacing distance of the second connection wing is greater than the third lateral spacing distance of the flange; and the second non-coplanar portion of each of the connection wings extends from the respective first non-coplanar portion by a different distance relative to the second non-coplanar portion of the other connection wing.

17. A decking system comprising:

first and second laterally adjacent, elongate decking members each having generally planar, generally parallel top and bottom surfaces interconnected by left and right longitudinal side edges, at least one of said side edges having a longitudinal slot formed therein, wherein a first longitudinal slot formed in the first decking member lies laterally adjacent and opposed to a second slot formed in the second decking member; and a fastener for securing the decking members together and to a support member that underlies and supports the decking members, said fastener comprising:

a generally flat body portion having front and rear faces, said body portion being positioned between the laterally adjacent decking members, said body portion having left and right parallel edges;

a first connection wing attached to the body portion and extending outwardly from the rear face of the body portion and into the second longitudinal slot of the second decking member;

a second connection wing attached to the body portion and extending outwardly from the front face of the body portion and into the first longitudinal slot of the first decking member; and a flange attached to a bottom edge of the body portion and extending outwardly from the rear face of the body portion, said flange establishing a gap between the decking members greater than a thickness of the body portion, wherein a bottom surface of the flange abuts the support member;

a side flange attached to one of the left and right edges of the body portion, wherein a distal portion of the side flange is generally perpendicular to the body portion, and wherein the side flange extends out from the rear face of the body portion;

wherein the fastener is connected to the support member by way of an elongate connector extending through an opening in the fastener and into the support member, said opening being defined by at least one of the flange and the body portion;

wherein the connection wings engage the decking members in the slots for securing the decking members against the support member; and wherein each connection wing comprises first and second non-coplanar portions, and wherein each second non-coplanar portion is inclined at an angle with respect to the first non-coplanar portions.

18. The decking system of claim 17, wherein:

during installation, the connection wings are flexed downwards towards the flange, the non-coplanar portions thereby exerting a leveraged force at least partly upwards against the decking members in the slots for facilitating engagement of the connection wings with the decking members.

19. The decking system of claim 18, wherein the second connection wing is flexed upon tightening the connector into the support member through the opening, thereby drawing the body portion into butting engagement with the first decking member, and wherein the first connection wing is flexed upon placement of the second decking member against the support member subsequent to angling the slot of the second decking member over the first connection wing.

20. The decking system of claim 18, wherein the first connection wing extends out from the body portion by a lateral distance greater than that of the second connection wing, for the first connection wing to extend into the slot of the second decking member notwithstanding the gap created by the flange.

21. A fastener for securing laterally adjacent, grooved decking members having longitudinal grooves formed in sides of the decking members to an underlying support that underlies and supports the decking members, said fastener comprising:

a generally flat body portion having left and right parallel edges;

flange means connected to the body portion for establishing a gap between the decking members; and connection means connected to the body portion for engaging the decking members, said decking members being engaged in longitudinal grooves of the decking members;

wherein the fastener includes an opening for passage of a connector to connect the fastener to an underlying support; and wherein the flange means includes a side flange attached to one of the left and right edges of the body portion, a distal portion of the side flange is generally perpendicular to the body portion, and the side flange extends out from the body portion.

22. The fastener for securing laterally adjacent, grooved decking members to an underlying support according to claim 21, wherein the connection means extend away from the body portion beyond the flange to engage the longitudinally extending grooves that are laterally adjacent.

23. A fastener for securing laterally adjacent decking members having longitudinally extending grooves having an upper surface formed in sides of the decking members to an underlying support of a deck, the fastener comprising:

a narrow body portion to be interposed between adjacent decking members at an underlying support, the body portion having a top portion for location in the region of longitudinally extending grooves of the decking members, a bottom portion for facing the underlying support, a front surface for facing a first of the adjacent decking members and a rear surface for facing a second of the adjacent decking members;

a first connection wing attached to the top portion of the body portion projecting generally outwardly from the front surface of the body portion in a first direction and being bent upwardly for engagement in a longitudinally extending groove of the first of the adjacent decking members;

a second connection wing attached to the top portion of the body portion projecting generally outward from the rear surface of the body portion in a second direction opposite to the first direction and being bent upwardly for engagement in a longitudinally extending groove of the second of the adjacent decking members; and the bottom portion of the body portion being adapted to be connected to an underlying support by a connector to secure a decking member to the underlying support;

wherein each of the first and second connection wings comprises first and second non-coplanar portions, each first non-coplanar portion abuts the body portion and each second non-coplanar portions abuts the respective first non-coplanar portion, defines a distal end of the respective connection wing, and is bent upwardly for engaging an upper surface of a longitudinally extending groove, the first non-coplanar portions define a plane, and the second non-coplanar portions are angled at angles with respect to the plane defined by the first non-coplanar portions, the angle of one second non-coplanar portion with respect to the plane being different from the angle of the other second non-coplanar portion.

24. The fastener for securing laterally adjacent, grooved decking members to an underlying support as defined in claim 23 wherein:

the bottom portion of the body portion has an opening for passage of an elongated connector through the bottom portion into an underlying support.

25. The fastener for securing laterally adjacent, grooved decking members to an underlying support as defined in claim 23 wherein:

the first and second connection wings are longitudinally offset from one another.

26. The fastener for securing laterally adjacent, grooved decking members to an underlying support as defined in claim 23 wherein:

at least one of the connection wings is bent with a curved portion.

27. The fastener for securing laterally adjacent, grooved decking members as defined in claim 23 wherein:

an end of at least one of the connection wings that projects from the body portion has a bent portion with prongs for engagement with a longitudinally extending groove.

28. The fastener for securing laterally adjacent, grooved decking members as defined in claim 23 wherein:

the fastener is a unitary member bent to shape from sheet metal.

29. A decking system comprising:

first and second longitudinally extending decking members resting on an underlying support with laterally adjacent edges of the members in side-by-side relationship, each of the laterally adjacent edges having a longitudinally extending groove having an upper surface;

a fastener for securing the first and second decking members together to the underlying support, the fastener having a narrow body portion interposed between the decking members above the underlying support, the body portion having a top portion positioned between the longitudinally extending grooves, and a bottom portion located adjacent the underlying support;

a first connection wing attached to the top portion of the body portion and projecting generally outward of the body portion into the longitudinally extending groove of the first decking member and being bent upwardly so as to engage the groove;

a second connection wing attached to the top portion of the body portion and projecting generally outward of the body portion into the longitudinally extending groove of the second decking member and also being bent upwardly so as to engage the longitudinally extending groove;

the bottom portion of the body portion being adapted to be engaged by a connector; and an elongated connector engaging the bottom portion of the fastener and the underlying support to draw the fastener and the first and second decking members downward against the underlying support;

wherein each of the first and second connection wings has first and second non-coplanar portions, each first non-coplanar portions abuts the body portion and each second non-coplanar portion abuts the respective first non-coplanar portions, defines a distal end of the respective connection wing, and is bent upwardly for engaging the upper surface of the longitudinally extending groove, and one first non-coplanar portion extends from the body portion by a different distance relative to the other first non-coplanar portion.

30. The decking system as defined in claim 29 wherein:

the first and second connection wings are longitudinally offset from one another and engage the first and second decking members in longitudinally offset relationship for securing the decking members to the same underlying support.

31. The decking system as defined in claim 29 wherein:

the dimensions of the fastener between the bottom portion and the first and second connection wings at the top portion are approximately the same as the dimensions between the grooves in the first and second decking members and the underlying support to which the decking members are connected by the fastener.

32. The decking system as defined in claim 29 wherein:

the first connection wing is bent with a curved portion to engage the groove in the first decking member, and the second connection wing is bent with a curved portion to engage the groove in the second decking member.

33. A fastener for securing laterally adjacent grooved decking members to an underlying support, the fastener comprising:

a generally flat body portion having front and rear faces and top and bottom edges;

a main flange attached to the bottom edge of the body portion and extending generally outwardly from the rear face of the body portion; and first and second connection wings attached to the top edge of the body portion and extending generally outwardly in substantially opposing directions from the rear face and the front face of the body portion, respectively; wherein:

at least one of the main flange and the body portion defines an opening for passage of an elongated connector;

the first and second connection wings extend outwardly from respective positions along the top edge of the body portion that are longitudinally offset from one another;

the first and second connection wings are bent upwardly for engagement in a longitudinally extending groove of respective adjacent decking members; wherein the first and second connection wings are asymmetrical; and the fastener is made from a unitary piece of cut and bent sheet metal.

34. The fastener according to claim 33, wherein:

the body portion further comprises left and right edges; and the fastener further comprises:

a side flange extending outwardly from the rear face of the body portion along one of the left and right edges of the body portion, wherein the side flange defines a gap between adjacent decking members greater than a thickness of the body portion.

35. A fastener for securing laterally adjacent grooved decking members to an underlying support and for spacing the laterally adjacent grooved decking members relative to one another, the fastener comprising:

a body portion having front and rear faces and top, bottom, left and right edges;

a pair of connection wings extending from the front face and the rear face of the body portion, respectively, and configured to engage grooves of adjacent decking members;

a main flange attached to the bottom edge of the body portion and extending generally outwardly from the rear face of the body portion, wherein at least one of the body portion and the main flange defines an opening for passage of an elongated connector; and a side flange extending outwardly from the rear face of the body portion along one of the left and right edges of the body portion, wherein the side flange defines a gap between adjacent decking members greater than a thickness of the body portion.

* * * * *